US005123554A

United States Patent [19]

Arvidson et al.

[11] Patent Number: 5,123,554

[45] Date of Patent: Jun. 23, 1992

[54] RETORTABLE PLASTIC CONTAINERS

[75] Inventors: Russell A. Arvidson, Mundelein, Ill.; Thomas A. Vandewalle, Worthington, Ohio

[73] Assignee: Abbott Laboratories, Abbott Park, Ill.

[21] Appl. No.: 715,056

[22] Filed: Jun. 13, 1991

Related U.S. Application Data

[63] Continuation of Ser. No. 265,076, Oct. 31, 1988, abandoned.

[51] Int. Cl.[5] ..... B65D 1/40; B65D 23/08

[52] U.S. Cl. ..... 215/12.2; 215/1 C; 215/100 A; 220/669; 220/672; 220/675; 426/112; 426/115

[58] Field of Search ..... 215/1 C, 12.2, 12.1, 215/100 A, DIG. 3; 604/403; 220/415, 666, 675, 669, 672; 222/107, 215, 185; 426/115, 112

[56] References Cited

U.S. PATENT DOCUMENTS

| | | | |
|---|---|---|---|
| 3,158,283 | 11/1964 | Rinfret et al. | 604/403 X |
| 3,286,902 | 11/1966 | Hunter et al. | 220/72 |
| 3,297,194 | 1/1967 | Schaper et al. | 220/72 |
| 3,448,775 | 6/1969 | Limbach et al. | 220/72 X |
| 3,537,498 | 11/1970 | Amand | 215/100 A X |
| 3,926,341 | 12/1975 | Lhoest | 215/100 A X |
| 4,013,187 | 3/1977 | Betka | 215/100 A |
| 4,550,043 | 10/1985 | Beck | 215/1 C X |
| 4,579,170 | 4/1986 | Moses et al. | 220/72 X |
| 4,610,366 | 9/1986 | Estes et al. | 215/1 C |
| 4,733,804 | 3/1988 | Slat et al. | 220/72 X |

FOREIGN PATENT DOCUMENTS

| | | | |
|---|---|---|---|
| 181165 | 10/1984 | Japan | 604/403 |

*Primary Examiner*—Sue A. Weaver

*Attorney, Agent, or Firm*—Lonnie R. Drayer; Donald O. Nickey

[57] ABSTRACT

A multi-layer co-extrusion blow molded plastic container adapted to be filled with a heat-sensitive nutrient and then retorted at relatively high temperatures to sterilize the contents thereof, the contents being agitated by rotating the container while it is being retorted and certain of the side walls being ribbed to both increase the surface area of the container and thus the heat transfer properties thereof and to aid in agitation of the contents whereby to minimize the time period the heat-sensitive contents must be exposed to such high temperatures for sterilization thereof, and the method of providing such a sterile container of heat-sensitive nutrient.

4 Claims, 3 Drawing Sheets

RETORTABLE PLASTIC CONTAINERS

This is a continuation of application Ser. No. 07/265,076, filed Oct. 31, 1988, now abandoned.

BACKGROUND OF THE INVENTION

The present invention relates to a semi-rigid plastic container which may be pre-filled with a highly heat-sensitive liquid food product after which the filled container may be retorted to sterilize the contents thereof. Most known semi-rigid plastic containers may not be retort-sterilized when filled with highly heat-sensitive liquid food products as the length of time and high temperatures required for such sterilization processes result in unacceptable deformation of such containers and/or damage to the highly heat-sensitive food products contained therein.

SUMMARY OF THE INVENTION

The present invention relates to a new and novel semi-rigid plastic container which, due to its structure, composition and method of fabrication, may be pre-filled with a highly heat-sensitive liquid food product and then retort-sterilized without container deformation and without damage to the contents thereof. These retort-sterilized containers will have a long shelf life whereby a hospital, nursing home or other health facility may maintain an inventory of easily storable, ready-to-use semi-rigid containers of sterilized nutritional products for tube-feeding of its patients. This unique container is formed by a coextrusion blow-molding process with the multi-layer coextrusion being characterized by at least one high-oxygen-barrier layer. The container is formed with a ribbed formation on one or more of the sidewalls thereof whereby to increase the heat transfer properties thereof and thus reduce the high-heat sterilization process time and thus the likelihood of container deformation and/or damage to the highly heat-sensitive contents thereof. The method of providing the sterilized pre-filled containers of liquid nutrient also includes the step of agitating the contents of the container during both the heat-up and cool-down cycles, as by rotating the pre-filled containers in the retort, to maximize the heat transfer characteristics thereof and also the step of pressurizing the retort during both the heat-up and cool-down cycles to minimize container deformation.

DESCRIPTION OF THE PREFERRED EMBODIMENT

Figure 1:
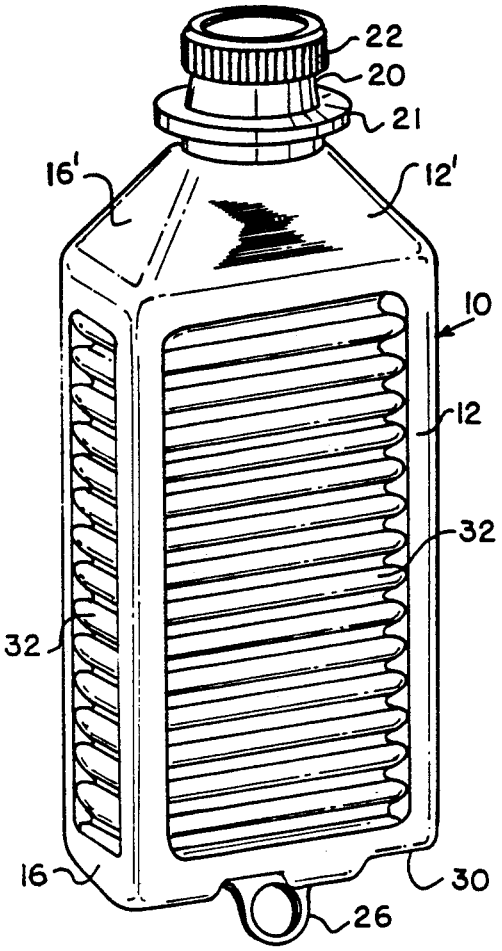
FIG. 1 is a front perspective view of a retortable, coextrusion blow-molded, semi-rigid plastic container embodying the invention and shown in its upright position.
Figure 2:
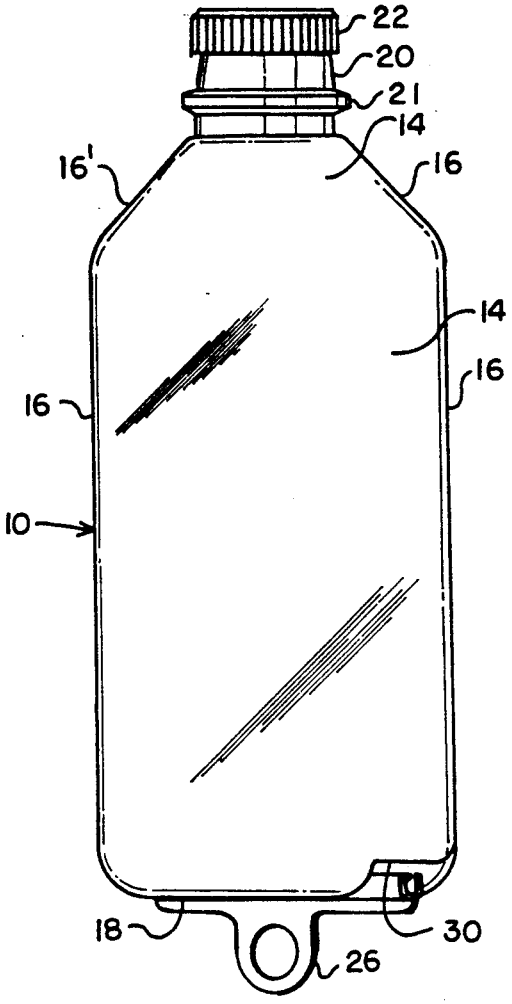
FIG. 2 is a rear elevational view thereof.
Figure 3:
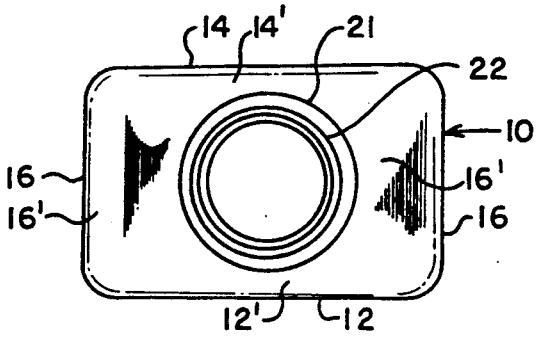
FIG. 3 is a top plan view thereof.
Figure 5:
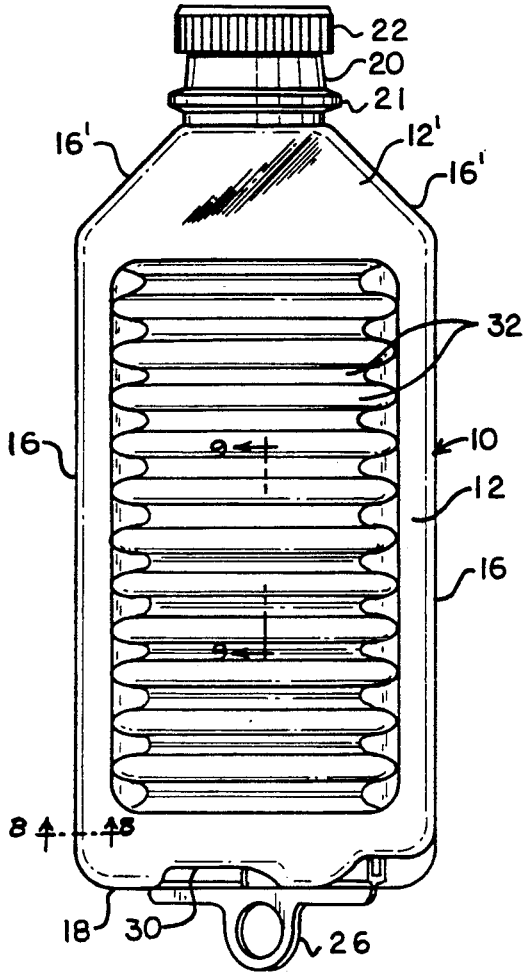
FIG. 5 is a front elevational view thereof.
Figure 4:
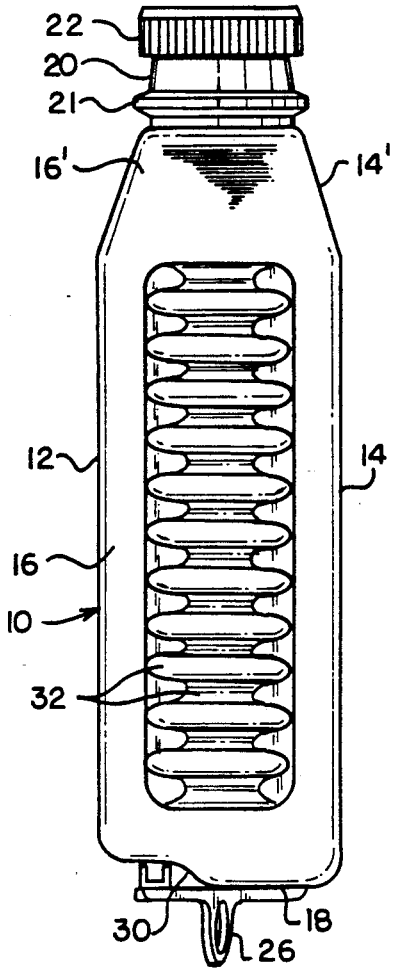
FIG. 4 is a side elevational view thereof.
Figure 6:
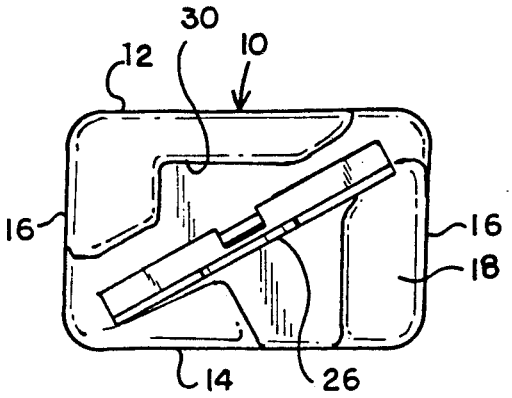
FIG. 6 is a bottom plan view thereof.

Historically, retortable containers had to be fabricated of glass or metal as plastics have relatively low thermal conductivity and low melting points. However, plastic containers do have greater consumer appeal than glass or metal containers and the previous concerns as to retortable plastic containers have now been overcome. Referring now to the drawings, a preferred form of a semi-rigid plastic container 10 embodying the present invention is shown in its upright filling or one of its storage positions in FIGS. 1–6. This container 10, because of its unique structure, composition, and method of fabrication, may be pre-filled with a highly heat-sensitive liquid medical nutritional product and then heated in a retort to sterilize said product. This retort-sterilized plastic container 10 of medical nutritional product has a long shelf life whereby hospitals, nursing homes, and other health facilities may maintain an inventory of easily storable, ready-to-use, semi-rigid, plastic containers of sterilized nutritional products for tube-feeding of its patients. The container 10 is preferably formed by a multi-layer co-extrusion blow-molding process, the characteristics and properties of which multi-layer co-extrusion will be described hereinafter.

Figure 7:
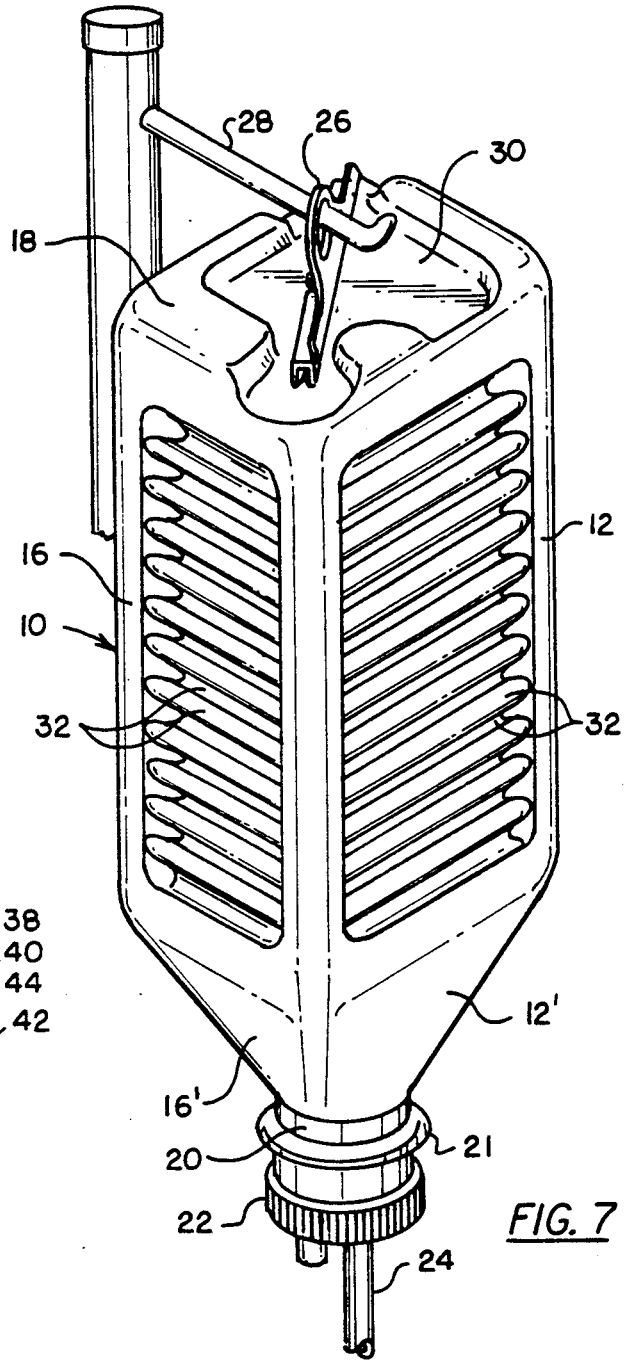
FIG. 7 is a front perspective view of the container of FIG. 1 when inverted and adapted for feeding a patient.

As shown in FIGS. 1–6, the container 10 is generally rectangular in configuration and is characterized by a front wall 12, a rear wall 14, a pair of side walls 16, and a bottom wall 18. In the embodiment illustrated in the drawings, the transverse or horizontal dimensions of the front and rear walls 12 and 14 are substantially greater than that of the side walls 16. The upper portions of the four walls 12, 14, and 16, converge upwardly to define inwardly inclined portions, 12', 14', and 16' which define an open-topped generally cylindrical neck-portion 20 which may be provided with an annular rib 21. The neck portion 20 may be threaded for sealingly receiving a threaded cap 22 which may be spikable or piercable to receive a feeding tube set 24 (FIG. 7). Although not shown in the drawings, a foil cover is heat sealed over the open neck portion 20 immediately after filling of the container 10 in a manner well known in the medical art. As an alternative to the threaded cap 22, a plastic protective cap (not shown) may be snap-fitted over the neck portion 20 of the container 10. As an alternative to the feeding tube set 24, a feeding tube set which includes a cap having a foil-cutting plow may be used when preparing container 10 for tube-feeding of a patient.

A fixed or removable hanger 26 may be provided on the bottom wall 18 of the container 10 for supporting same in an inverted feeding position from a support bar 28 at a patient's bedside as shown in FIG. 7. The bottom wall 18 may be recessed, as at 30, to accommodate the hanger 26 when folded into an out-of-the-way position to permit upright support of the container 10 on a generally flat or level surface, as during storage thereof.

Figure 9:
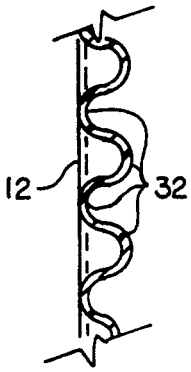
FIG. 9 is a fragmentary vertical sectional view taken generally along line 9—9 of FIG. 5.

As illustrated in the drawings, the front and side walls 12 and 16 are characterized by a plurality of horizontally disposed offset ribbed formations 32 which serve to increase the surface area of the container 10 in direct contact with the contents thereof. As illustrated in FIG. 9, which is a vertical sectional view taken generally along line 9—9 of FIG. 5, the thickness of the walls in the rib formations 32 is substantially constant. The ratio of the surface area of a container to its fill volume is critical when high heat transfer rates are involved. The higher the ratio, the higher the heat transfer rate and the shorter the heat or cook time to reach sterility. Although the rear wall 14 could also be provided with similar offset ribbing, it is often preferred that one wall of such a container be left unribbed to provide an area for content and/or patient labeling.

Figure 8:
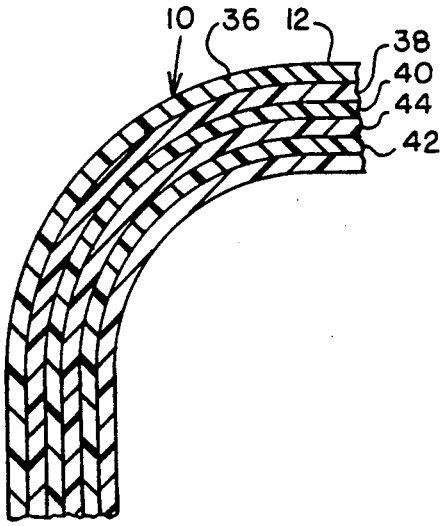
FIG. 8 is an enlarged fragmentary horizontal sectional view illustrating the layered structure of the container wall and taken generally along line 8—8 of FIG. 5.

With reference to FIG. 8, the multi-layered wall structure of the container 10 is characterized by inner and outer layers 34 and 36 both of which are of a food-grade polypropylene having a minimum thickness of 0.002 inches, a regrind layer 38 adjacent the outer layer 36, a pair of high temperature adhesive layers 40 and 42, such as 0.0015 inch polyolephin disposed adjacent the regrind layer 38 and the inner layer 34, respectively, and, between the two high temperature adhesive layers 40 and 42, an oxygen barrier layer 44 of ethyl-vinyl-alcohol (EVOH) having a thickness of from 0.0015 to 0.002 inches.

This new and unique method of providing pre-filled, sterilized, semi-rigid plastic containers 10 of highly heat-sensitive liquid medical nutritional products of the present invention comprises the basic steps of 1) forming the container 10, 2) filling and sealing the container 10, and 3) sterilizing the filled container 10 in a retort. The problems considered and overcome in producing this pre-filled, semi-rigid plastic container 10 of sterilized highly heat-sensitive liquid medical nutritional product included minimizing the length of the heating portion of the sterilization cycle so as to prevent damage to the various highly heat-sensitive nutritional products to be contained therein and also minimizing distortion of the semi-rigid, but relatively thin-walled, plastic containers 10 during the heat-up and cool-down cycles of the sterilization step of the method.

The fabrication step of the method comprises a co-extrusion blow molding process utilizing known apparatus with the multi-layer co-extrusion being characterized by at least one high-oxygen-barrier layer 44 and with the formed container 10 having wall portions provided with the offset ribbed formations 32 which effectively increase the surface area of container contact with the liquid contents thereof and thus the heat transfer rate whereby to minimize the length of the heating portion of the sterilization step.

The filling and sealing steps may be accomplished in a known manner by known apparatus with the filled container 10 being immediately sealed by a heat-sealed foil cover after which either a threaded cap 22 or a snap-on cap is provided over the foil seal.

The sterilization step comprises a heat-up portion in a known-type retort (not shown) and a cool-down portion in the same retort with both temperature and time being critical. With the heat-sensitive liquid nutritional products with which the containers 10 are filled, the maximum temperature in the retort should be limited to 275° F. The heating period may be minimized by agitating the contents of the container 10 during the heating cycle as by axial or end-to-end rotation of the containers 10 in the retort by any suitable known rotation means. It is noted that the offset ribbed formations 32, in addition to providing increased surface area for improving the heat transfer rate, also provide secondary agitation of the liquid contents of the container 10 during rotation thereof. This combination of agitation of the container contents and the greater surface area contact thereof with the container 10 due to the ribbed configuration of the container walls thus improves the heat transfer rate of the method and minimizes the possibility of damaging the highly heat-sensitive liquid nutritional products that could result from too long an exposure to the heat required for sterilization thereof. For example, some liquid nutritional products will degrade and caramelize upon extended exposure to high temperatures.

By pressurizing the interior of the retort by known methods, particularly during the cool-down cycle, any undesirable deformation of the relatively thin-walled container 10 is minimized.

While there has been shown and described a preferred embodiment of the invention, it would be obvious to those skilled in the art that changes and modifications may be made without departing from the invention, and it is intended by the appended claims to cover all such changes and modifications as fall within the true spirit and scope of the invention.

What is claimed as new and desired to be secured by Letters Patent of the United States is:

1. A plastic container for a heat-sensitive nutritional product, comprising a retortable multilayer plastic bottle, said bottle being generally rectangular in configuration and having a front wall, a rear wall, a pair of side walls and a bottom wall the front and side walls only are characterized by a plurality of horizontally extending rib formations which extend partially thereacross, the thickness of the walls in said rib formations being substantially constant, said front wall being joined to said side walls by corners which are free of said rib formations, and hanger means on said bottom wall.

2. A plastic container as recited in claim 1 wherein said hanger means is removably attachable to said bottom wall.

3. A plastic container as recited in claim 1 wherein the container comprises six layers which comprise from the exterior of the container to the interior of the container; (a) a layer of food-grade polypropylene, (b) a layer of regrind material, (c) a layer of a high temperature adhesive, (d) a layer comprising an oxygen barrier of ethyl-vinyl-alcohol, (e) a layer of a high temperature adhesive, and (f) a layer of food-grade polyethylene.

4. A plastic container as recited in claim 1 wherein said front, back and side walls have upper portions which converge to define inclined portions communicating with a neck portion.

* * * * *